US005216870A

United States Patent [19]

Boriani et al.

[11] Patent Number: 5,216,870

[45] Date of Patent: Jun. 8, 1993

[54] METHOD AND DEVICE FOR PRODUCING PARTABLE CIGARETTE CARTONS

[75] Inventors: Silvano Boriani; Alessandro Minarelli, both of Bologna, Italy

[73] Assignee: G.D. Societa' Per Azioni, Bologna, Italy

[21] Appl. No.: 912,276

[22] Filed: Jul. 13, 1992

[30] Foreign Application Priority Data

Jul. 16, 1991 [IT] Italy ..... B091A 000253

[51] Int. Cl.[5] ..... B65R 35/30; B65R 11/08

[52] U.S. Cl. ..... 53/448; 53/466; 53/462; 53/207; 53/228; 53/202

[58] Field of Search ..... 53/448, 462, 466, 207, 53/202, 228

[56] References Cited

U.S. PATENT DOCUMENTS 4,424,658 1/1984 Focke ..... 53/466 X
4,617,780 10/1986 Focke et al. ..... 53/466
4,631,895 12/1986 Ghiretti ..... 53/207
4,631,900 12/1986 Mattei ..... 53/448
5,058,363 10/1991 Focke et al. ..... 53/466 X

*Primary Examiner*—John Sipos
*Attorney, Agent, or Firm*—Sandler, Greenblum & Bernstein

[57] ABSTRACT

A method and device for producing partable cartons for packets of cigarettes, each carton being defined by two separate boxes formed from two substantially similar blanks, each divided by bend lines into a first and second panel on either side of an intermediate connecting portion, and at least one of which panels presents a lid tab; the carton being produced by feeding the two blanks, one upside down in relation to the other, along respective paths; folding the two second panels perpendicularly arranging the two second panels one on top of the other; feeding respective rows of packets on to the two second panels; and folding the remaining portions of the two blanks about the respective rows of packets.

7 Claims, 5 Drawing Sheets

METHOD AND DEVICE FOR PRODUCING PARTABLE CIGARETTE CARTONS

BACKGROUND OF THE INVENTION

The present invention relates to a method of producing partable cigarette cartons.

Cigarettes are normally supplied to retailers in cartons, usually containing ten packets arranged in two superimposed longitudinal rows of five packets each.

Following a demand among retailers for cartons that can be split into at least two halves, for enabling the sale of half cartons, i.e. a substantially closed box normally containing five packets, partable cartons are now produced consisting of two separate boxes, each containing a row of five packets, and which may or may not be joined by external adhesive elements; or consisting of two partable boxes having at least one portion in common, as described for example in U.S. Pat. No. 4,631,900.

The two boxes of known partable cartons as described above are normally formed from two identical or substantially identical blanks, each divided by bend lines into a first and second panel on either side of an intermediate connecting portion, and at least one of which panels presents a lid tab for closing a lateral opening on the box opposite the intermediate connecting portion.

SUMMARY OF THE INVENTION

It is an object of the present invention to provide a straightforward, rapid, relatively low-cost method of producing partable cartons of the aforementioned type.

According to the present invention, there is provided a method of producing partable cartons for packets of cigarettes, consisting of two separate boxes formed from two flat blanks, each divided by bend lines into a first and second panel on either side of an intermediate connecting portion, and at least one of which panels presents a lid tab; said method being characterized by the fact that it comprises stages consisting in feeding the two flat blanks, one upside down in relation to the other, along respective paths; squarely folding the two second panels; arranging the two second panels one on top of the other, and the two intermediate portions side by side and coplanar with each other; feeding respective rows of packets on to the two second panels; and folding the remaining portions of the two blanks about the respective rows of packets for forming said two boxes.

The present invention also relates to a device for implementing the above method.

According to the present invention, there is provided a device for implementing the above method, characterized by the fact that it comprises first and second conveyor means for feeding the two flat blanks along respective paths, a first blank with said second panel facing forward, and the other upside down in relation to the first; a loading station; first and second folding means cooperating respectively with said first and second conveyor means, for perpendicularly folding the two second panels, and transferring the two blanks to said loading station with the second panels folded squarely and arranged one on top of the other, and the two intermediate portions arranged side by side and coplanar with each other; means for feeding respective rows of packets to said loading station and on to said two second panels; and further folding means for folding the remaining portions of the two blanks about the respective rows of packets.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
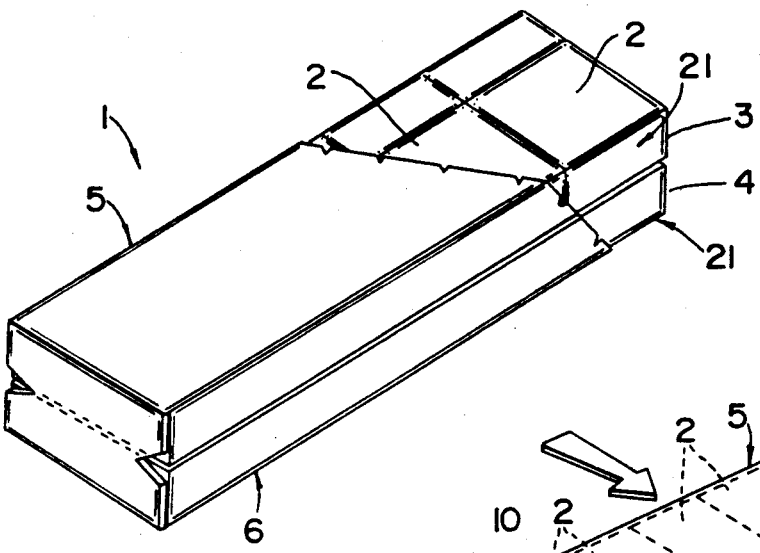
FIG. 1 shows a view in perspective, with parts removed for clarity, of a partable carton produced using the method and device according to the present invention.

Number 1 in FIG. 1 indicates a partable carton for packets of cigarettes 2 arranged in two superimposed longitudinal rows 3 and 4, in each of which packets 2 are rotated 180° about the longer longitudinal axis (FIG. 10) in relation to those in the other row. Carton 1 is substantially in the form of a rectangular parallelepipedon, and is defined by two partable boxes 5 and 6 also in the form of a rectangular parallelepipedon and defining respective half cartons, each containing a respective row 3, 4 of packets 2.

Figure 4:
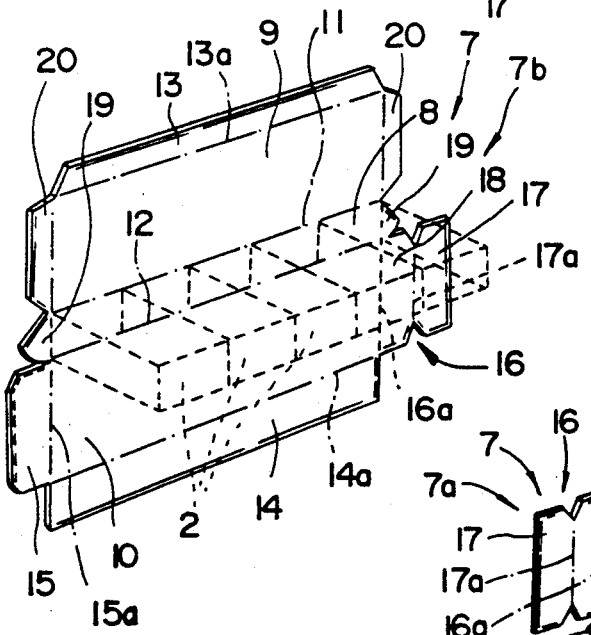
FIGS. 3 and 4 show spreadout views in perspective of respective details in FIGS. 1 and 2.
Figure 3:
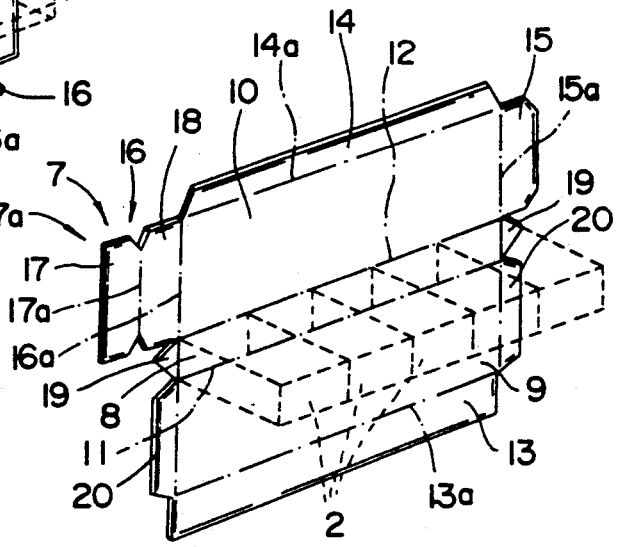
Figures 5, 6:
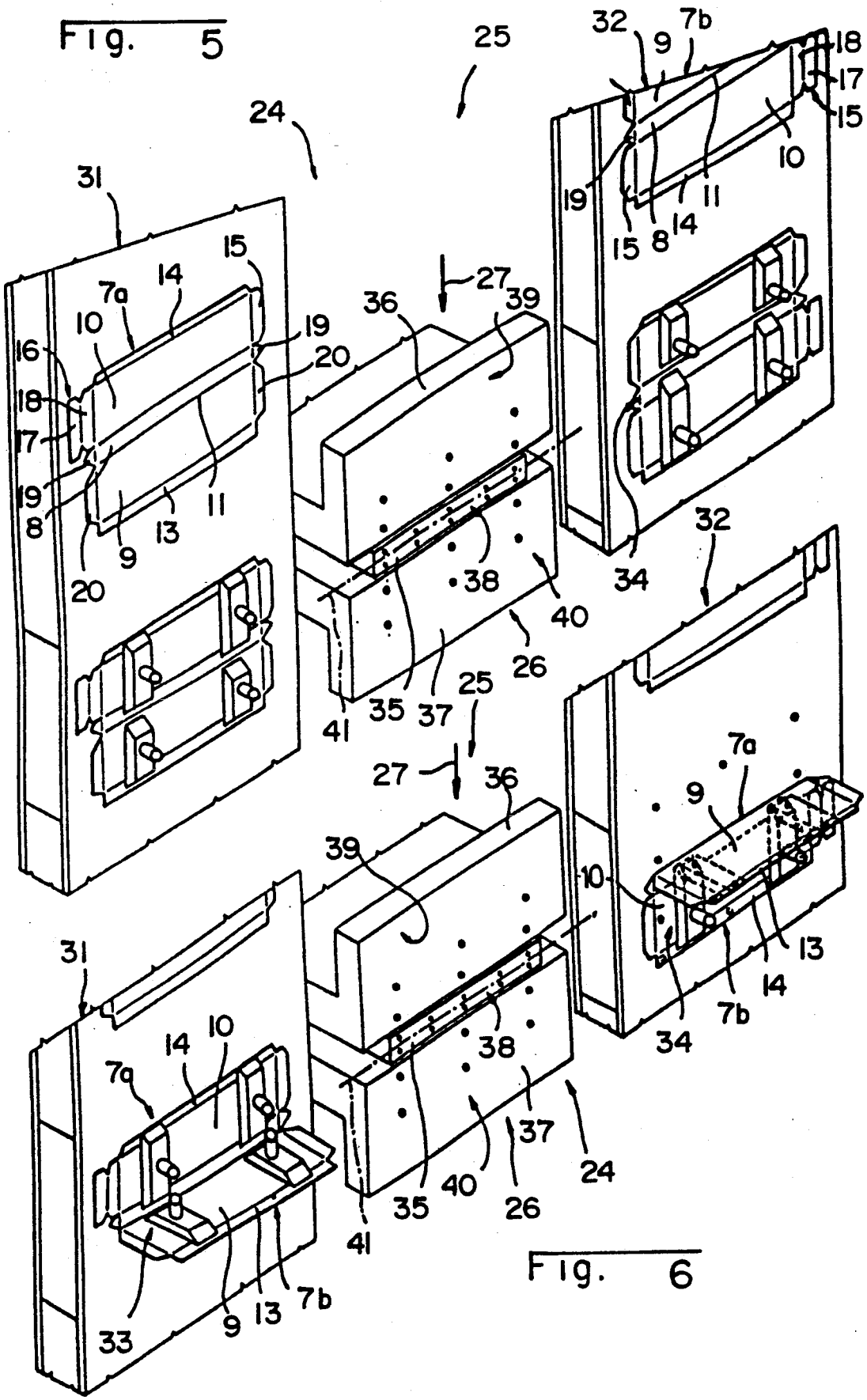
FIGS. 5 to 10 show successive stages in the formation of the FIG. 1 carton using the method and device according to the present invention.
Figures 7, 8:
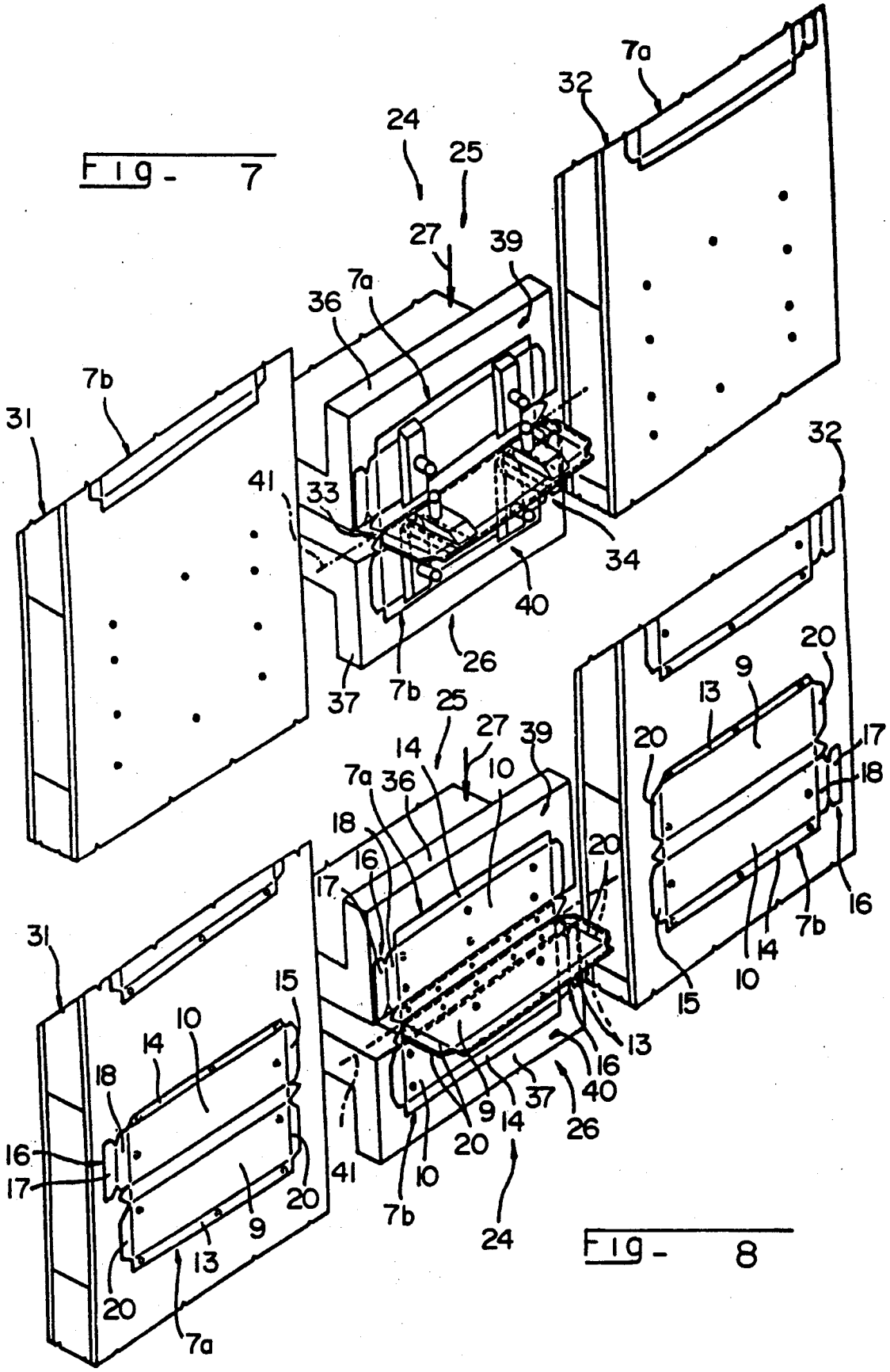

As shown more clearly in FIGS. 3 and 4, boxes 5 and 6 are defined by respective blanks 7, numbered respectively *7a* and *7b*, each comprising a continuous intermediate longitudinal portion 8 constituting a longitudinal portion of a small lateral wall of carton 1; and two lateral longitudinal portions on either side of intermediate portion 8, defining respective panels 9 and 10, each constituting a large lateral wall of respective box 5, 6, and connected to intermediate portion 8 along a respective longitudinal bend line 11, 12. Panel 9 of each blank *7a*, *7b* is located between intermediate portion 8 and a longitudinal lid tab 13 connected to a longitudinal edge of panel 9 along a bend line 13*a*.

Panel 10 of each blank *7a*, *7b* is located between intermediate portion 8 and a longitudinal lid tab 14 connected to a longitudinal edge of panel 10 along a bend line 14*a*.

More specifically, tab 13 of blank *7a* is substantially the same size as intermediate portion 8, while tab 14 is the same length but narrower than intermediate portion 8. Tabs 13 and 14 of blank *7b* are respectively the same as tabs 14 and 13 of blank *7a*.

From a first longitudinal end of panel 10 of each blank *7a*, *7b*, there extends axially outwards an end tab 15 connected to panel 10 along a bend line 15*a*; while, from the other end of panel 10, there extends outwards an end fold 16 connected to panel 10 along a bend line 16*a* and divided, by a further bend line 17*a* parallel to line 16*a*, into two tabs 17 and 18 substantially similar to each other and to tab 15.

At each end, intermediate portion 8 of each blank *7a*, *7b* presents a foldable tab 19, which is connected, preferably gummed, to the inner surface of a respective substantially rectangular tab 20 extending from a respective longitudinal end of panel 9, and which in turn is connected, preferably gummed, to the inner surface of respective tab 15, 18.

Figure 2:
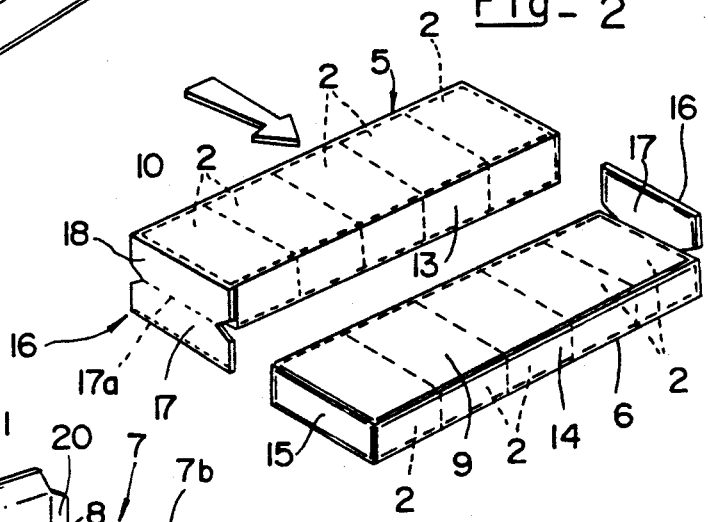
FIG. 2 shows an exploded view in perspective of the FIG. 1 carton.

As shown in FIG. 1 and, in particular, FIG. 2, each box 5, 6 is formed by successively and perpendicularly folding panel 10 about line 12; panel 9 about line 11; tabs 19; tabs 20 coplanar with respective tabs 19; and tabs 18 and 15 on to the outer surface of respective tabs 20. At this point, each box 5, 6 so formed presents a lateral opening 21, opposite respective intermediate portion 8, enabling access to packets 2 in respective row 3, 4, and which is closed by folding lid tabs 13 and 14 perpendicularly one on top of the other. More specifically, on box 5, tab 13, which is the same width as intermediate portion 8 but wider than tab 14, is folded outwards of respective tab 14; whereas, on box 6, tab 14, which is the same width as intermediate portion 8 but wider than tab 13, is folded outwards of respective tab 13.

Carton 1 is formed by placing boxes 5 and 6 one on top of the other, with panels 9 contacting each other, and by gumming tab 17 of each box 5, 6 on to the outer surface of tab 15 of the other box.

Carton 1 so formed is separated into two half cartons consisting respectively of boxes 5 and 6 by cutting or tearing end folds 16 along respective lines 17*a*.

Carton 1 as described above is produced by means of a cartoning device indicated as a whole by 24 and shown partially in FIGS. 5 to 10.

Device 24 comprises a feed unit 25 (FIGS. 5 to 8) for successively feeding pairs of blanks 7 to a loading station 26 along a first path, in the example shown, a vertical path in the direction of arrow 27; and a feed unit 28 (FIGS. 9 and 10) for successively feeding groups 29, each consisting of two superimposed rows 3 and 4 of packets 2, to loading station 26 along a second path, in the example shown, a horizontal path in the direction of arrow 30, and which intersects first path 27 at loading station 26.

As shown in FIGS. 5 to 8, path 27 is defined by two preferably suction conveyors 31 and 32 substantially parallel to each other on either side of loading station 26, and which provide for feeding station 26 with respective blanks 7*a*, 7*b* of respective boxes 5, 6. More specifically, conveyor 31 supplies blanks 7*a* of boxes 5 with panels 9 facing forwards in the traveling direction of the conveyor; while conveyor 32 supplies blanks 7*b* of boxes 6 upside down in relation to blanks 7*a* of boxes 5, i.e. with panels 10 facing forwards in the traveling direction of the conveyor, and in such a manner that each blank 7*b* on conveyor 32 presents line 11 substantially aligned with (but slightly ahead of) line 11 of respective blank 7*a* on conveyor 31.

Conveyors 31 and 32 feed each pair of blanks 7 forward in steps, so that, at each stop of conveyors 31 and 32, blanks 7 are arranged as described above (FIG. 5) on either side of loading station 26. At this point, blanks 7 are engaged by respective known folding units 33 and 34, which fold respective panels 9 perpendicularly (FIG. 6) in opposite directions (anticlockwise on conveyor 31 and clockwise on conveyor 32) about respective bend lines 11. By means of respective known actuators (not shown), folding units 33 and 34 are moved transversely in relation to respective conveyors 31 and 32, so as to transfer blanks 7 (FIG. 7), folded as described above, towards each other in the direction of lines 11 and on to loading station 26, where they are released (FIG. 8) in a loading position wherein panels 9 are arranged on top of and substantially contacting each other, perpendicular to the plane of convyors 31 and 32, with the remaining parts extending on either side of panels 9, substantially in the plane of conveyors 31 and 32.

As shown clearly in FIGS. 5 to 10, loading station 26 comprises a central suction type gripping element 35 located between two fixed suction type folding elements 36, 37, and moving, in relation to elements 36, 37 and perpendicular to the plane of conveyors 31, 32, to and from an idle position (FIGS. 5 to 8) wherein the front surface 38 of gripping element 35 is coplanar with conveyors 31, 32 and with front surfaces 39, 40 of folding elements 36, 37. More specifically, surface 38, which is substantially rectangular, is at least twice as wide as intermediate portion 8, and presents a longitudinal axis 41 parallel to path 30 and substantially coincident with lines 11 of the two blanks 7 in the above loading postion.

Figure 9:
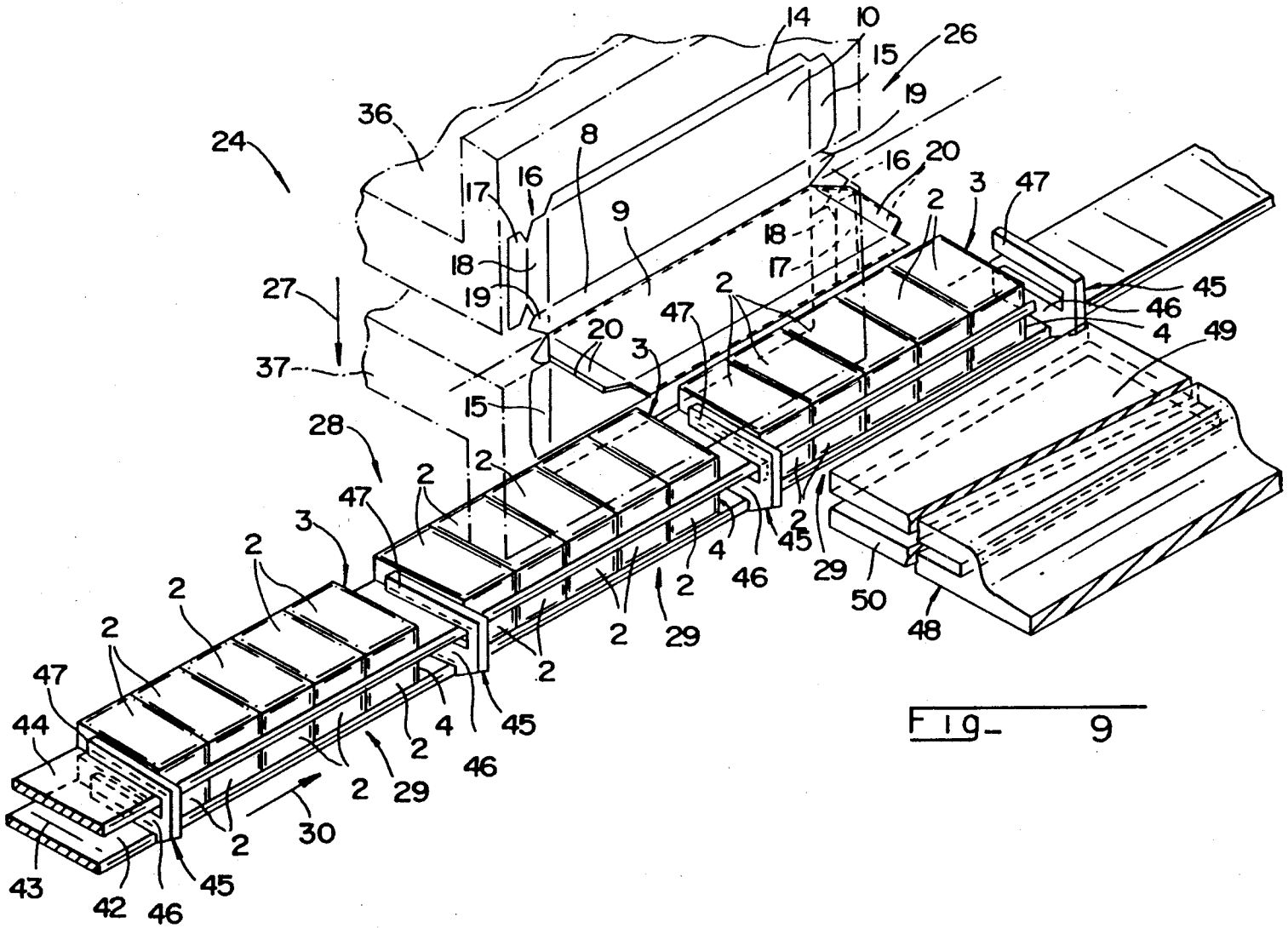

As shown in FIG. 9, feed unit 28 comprises a conveyor 42 having a belt 43 extending along path 30 and beneath a fixed elongated plate 44 extending parallel to belt 43 with a clearance at least equal to the thickness of packet 2. Belt 43 is fitted with a number of equally-spaced, substantially U-shaped pushers 45, separated by a distance at least equal to the length of rows 3, 4, and comprising two integral arms 46, 47, the first extending crosswise in relation to belt 43 in the gap between belt 43 and plate 44, and the second extending over plate 44. Each pusher 45 travels together with belt 43, for step-feeding station 26 with a respective group 29 wherein row 3 is fed along plate 44 by arm 47, and consists of packets 2 arranged with the front surface facing upwards, and wherein row 4 is fed forward directly by belt 43, in contact with respective arm 46, and consists of packets 2 arranged with the front surface facing downwards and contacting belt 43.

Plate 44 extends along path 30, perpendicular to the plane of conveyors 31, 32 and coplanar with axis 41, and presents a thickness at least equal to that of two superimposed panels 9 of two blanks 7 in the aforementioned loading position.

Figure 10:
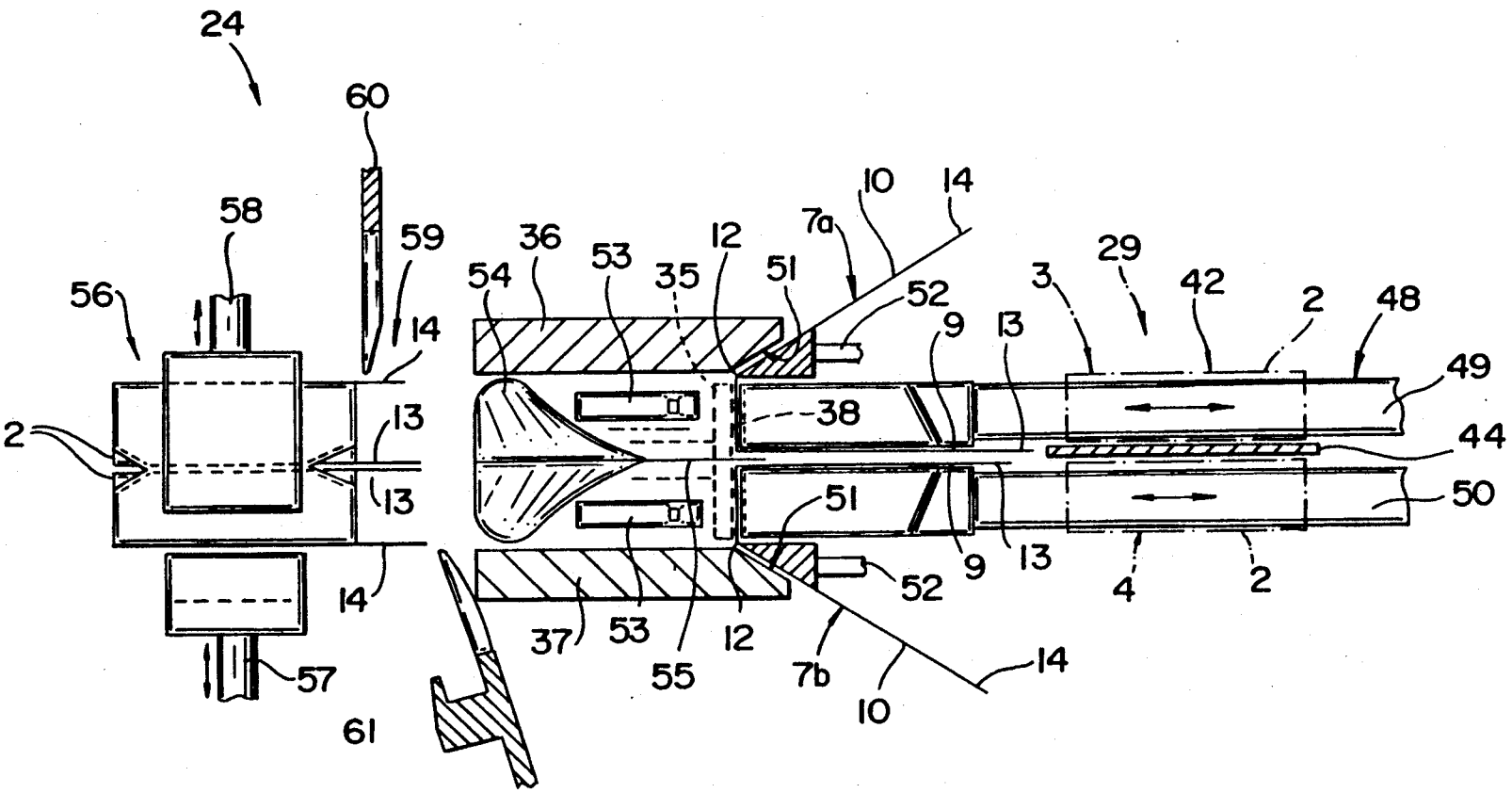

As shown particularly in FIG. 10, feed unit 28 also comprises a pusher 48 moving back and forth in a direction perpendicular to paths 27, 30, and located on the opposite side of conveyor 42 in relation to gripping element 35. Pusher 48 comprises two superimposed arms 49, 50 cooperating transversely with respective rows 3, 4 of group 29 on conveyor 42 in loading station 26, for transferring rows 3, 4 respectively on top of and beneath the flat element defined by the two contacting panels 9 of blanks 7 arranged in the loading position, with intermediate portions 8 contacting surface 38 of gripping element 35.

As shown in FIG. 10, upon rows 3, 4 contacting the inner surface of intermediate portions 8 of blanks 7, pusher 48 continues moving, together with gripping element 35, so as to insert blanks 7 and rows 3, 4 between fixed folding elements 36, 37, and so fold panels 10 squarely and in opposite directions about respective bend lines 12. To assist the latter operation, folding elements 36, 37 present respective beveled lead-in surfaces 51 cooperating, prior to insertion of packets 2, with respective wedge-shaped folding spindles 52 for prefolding panels 10 about respective bend lines 12.

Again with reference to FIG. 10, as pusher 48 and gripping element 35 move together between fixed folding elements 36, 37, tabs 19 are folded perpendicularly by two pairs of known fixed folding elements 53 (only one pair of which is shown); and tabs 20 are folded perpendicularly by two pairs of known helical folding elements 54 (only one pair of which is shown), the folding elements 54 in each pair extending in opposite directions from a common plate 55 coplanar with plate 44 and to the side of the path of gripping element 35.

As shown in FIG. 10, gripping element 35 and pusher 48 continue feeding group 29 and respective blanks 7 in the same direction past folding elements 54 and into a position (not shown) wherein a transverse pusher (not shown, for moving group 29 and blanks 7 transversely in relation to the FIG. 10 plane) releases them from gripping element 35 and pusher 48, and feeds them on to an output conveyor (not shown) through an output folding station 56.

In station 56, two movable folding elements 57 (only one of which is shown) fold respective tabs 15 squarely on to respective tabs 19 and 20; a further two movable folding elements 58 (only one of which is shown) fold respective end folds 16 with tab 18 on respective tabs 19 and 20, and tab 17 pressed on to the outer surface of tab 15 of the other blank 7; while a folding device 59, comprising two opposed folding elements 60 and 61, folds tabs 13 and 14 of each blank 7*a*, 7*b* one on top of the other.

A detailed description of the design and operation of folding device 59 is given in Italian Patent Application N. BO091A 000254, to which full reference is made herein in the interest of full disclosure.

Boxes 5 and 6, once completed and joined to form carton 1 by folding end folds 16, are fed, as described, on to said unloading conveyor (not shown).

Cartoning device 24 is thus not only highly straightforward but also extremely reliable, by virtue of substantially duplicating a known cartoning device of proved efficiency.

This is made possible by the method employed for producing carton 1. In fact, by virtue of conveying two substantially similar blanks 7, one upside down in relation to the other, and transferring them on to loading station 26 with panels 9 folded perpendicularly and one on top of the other, enables substantially all the other stages in the formation of carton 1 to be performed using substantially the same known technique employed for producing normal one-piece cartons.

To a technician of average ability, it will be clear that minor alterations may be made to the method described herein, for producing partable cartons differing slightly from carton 1, and wherein boxes 5 and 6 are either joined by common elements other than those described herein, or are completely separate, in which case, they may or may not be joined by external adhesive elements.

We claim:

1. A method of producing partable cartons for packets of cigarettes, comprising of two separate boxes formed from two flat blanks, each divided by bend lines into a first and second panel on either side of an intermediate connecting portion (8), and at least one of which panels presents a lid tab; said method comprises the steps of feeding the two flat blanks, with the second panel of a first blank leading in the feeding direction and the other blank upside down in relation to the first blank, along respective paths; perpendicularly folding the two second panels relative the first panels and the intermediate connecting portions; arranging the two second panels one on top of the other, and the two intermediate portions side by side and coplanar with each other; feeding respective rows of packets on to the two second panels; and folding the remaining portions of the two blanks about the respective rows of packets for forming said two boxes.

2. A method as claimed in claim 1, characterized by the fact that said two blanks are fed along said respective paths with said second panel and, respectively, said first panel (10) facing forwards.

3. A method as claimed in claim 1 characterized by the fact that the two blanks are folded in opposite directions, in relation to said respective second panels, about said respective rows of packets.

4. A methods as claimed in claim 1, characterized by the fact that said rows of packets are fed on to said respective second panels by feeding said rows along and on either side of a supporting plate to a loading station wherein said supporting plate is coplanar with and adjacent to said two second panels arranged one on top of the other; and by transversely transferring said two rows into contact with the intermediate portions of said blanks and on either side of said two second panels arranged one on top of the other.

5. A method as claimed in claim 4, characterized by the fact that said two rows are fed along said supporting plate with each packet in each row rotated 180° about its longer longitudinal axis in relation to a corresponding packet in the other row.

6. A device for implementing the method according to claim 1, said device comprising first and second conveyor means for feeding the two flat blanks along respective paths, a first blank with said second panel facing forward, and the other upside down in relation to the first; a loading station; first and second folding means cooperating respectively with said first and second conveyor means for perpendicularly folding the two second panels, and transferring the two blanks to said loading station with the second panels folded perpendicularly and arranged one on top of the other, and the two intermediate portions arranged side by side and coplanar with each other; means for feeding respective rows of packets to said loading station and on to said two second panels; and further folding means for folding the remaining portions of the two blanks about the respective rows of packets.

7. A device as claimed in claim 6, characterized by the fact that said feeding means comprise a supporting plate extending through said loading station and located, in use, coplanar with and adjacent to said two second panels arranged one on top of the other in said loading station; first push means for feeding said rows along and on either side of said supporting plate; and second push means for transversely transferring said two rows into contact with the intermediate portions of said respective blanks and on either side of said two second panels (9) arranged one on top of the other.

* * * * *

UNITED STATES PATENT AND TRADEMARK OFFICE

CERTIFICATE OF CORRECTION

PATENT NO. : 5,216,870

DATED : June 8, 1993

INVENTOR(S) : Silvano BORIANI et al.

It is certified that error appears in the above-indentified patent and that said Letters Patent is hereby corrected as shown below:

At column 5, line 57 (claim 1, line 5) delete "(8)".
At column 6, line 12 (claim 2, line 4) delete "(10)".
At column 6, line 61 (claim 7, line 11) delete "(9)".

Signed and Sealed this

Twelfth Day of September, 1995

*Attest:*

Bruce Lehman

BRUCE LEHMAN

*Attesting Officer*

*Commissioner of Patents and Trademarks*